United States Patent [19]

Serizawa

[11] 4,445,845

[45] May 1, 1984

[54] FLAMBEAU

[75] Inventor: Jiro Serizawa, Tokyo, Japan

[73] Assignee: Selon Co., Ltd., Japan

[21] Appl. No.: 299,285

[22] Filed: Sep. 4, 1981

[30] Foreign Application Priority Data

May 26, 1981 [JP] Japan ..... 56-75219[U]

[51] Int. Cl.[3] ..... F21V 35/00

[52] U.S. Cl. ..... 431/295; 248/188.7; 362/405

[58] Field of Search ..... 431/295, 296; 362/392, 362/405, 406, 409; 248/188.7; 211/205

[56] References Cited

U.S. PATENT DOCUMENTS

| | | | |
|---|---|---|---|
| 658,898 | 10/1900 | Kato, Jr. | 431/295 |
| 747,780 | 12/1903 | Schimpf | 431/295 |
| 859,707 | 7/1907 | Van Guelpen | 431/295 |
| 3,186,561 | 6/1965 | Strässle | 248/188.7 |
| 3,298,086 | 1/1967 | Gasser | 248/188.7 |

FOREIGN PATENT DOCUMENTS 45-24800 9/1970 Japan .

*Primary Examiner*—Lee E. Barrett
*Attorney, Agent, or Firm*—William A. Drucker

[57] ABSTRACT

The disclosure relates to a flambeau wherein a plurality of support arms are detachably connected to a pair of upper and lower connecting members, a connecting portion of each support arm being snugly received or frictionally engaged in the cavities and slots of the upper and lower connecting members so that the support arms can be firmly connected to the connecting members by friction without using an elongated screw. The lower end of the upper connecting member and the upper end of the lower connecting member are mated with each other, the connecting portion of the support arms being completely covered by the upper and lower connecting members and concealed from external view. The upper connecting member is threadedly connected at its upper end to a central decorative member and the lower connecting member is threadedly connected at its lower end to a base.

6 Claims, 7 Drawing Figures

FLAMBEAU

BACKGROUND OF THE INVENTION

1. Field of the Invention

This invention relates to a flambeau which can be disassembled.

2. Prior Art

A conventional flambeau has a plurality of radially extending arms for supporting candles and is assembled by connecting the component parts together by welding. Therefore, such a conventional flambeau has been found disadvantageous in that much time and labor are required for assembling the flambeau. Another significant disadvantage has been that such a known flambeau incapable of disassembly can not be packaged in a compact manner because of the presence of the radially extending support arms.

Japanese Utility Model Publication No. 45-24800 discloses a flambeau which overcomes the above deficiencies of the prior art. This conventional flambeau comprises a connecting member and a plurality of radially extending candle support arms detachably connected at their inner ends to the connecting member. The support arms are connected to the connecting member by fitting a cover member on the connecting member from below. However, this arrangement has proven not to provide a firm connection between the support arms and the connecting member, and the support arms tend to be disconnected from the connecting member in use. Another disadvantage is that the flambeau has a limited design and hence is rather aesthetically unappealing because it is constructed essentially of the connecting member and the radially extending support arms.

SUMMARY OF THE INVENTION

It is therefore an object of this invention to provide a flambeau which can be disassembled and in which connecting members and candle support arms are firmly connected together.

Another object is to provide such a flambeau which is aesthetically appealing.

According to the invention, there is provided a flambeau which comprises a pair of upper and lower elongated connecting members detachably connected in end to end relation, said upper and lower connecting members having a pair of axial cavities formed in their respective portions disposed adjacent to each other, said cavities opening to the mated ends of said connecting members, respectively, and being disposed in alignment with each other, each of said connecting members having a plurality of axial slots formed in said adjacent portion thereof and extending radially outwardly from said cavity and opening to the side thereof, said plurality of slots in said upper connecting member being disposed in alignment with said plurality of slots in said lower connecting member, said upper connecting member having a threaded portion at its upper end, and said lower connecting member having a threaded portion at its lower end; a plurality of support arms detachably connected at their inner ends to said upper and lower connecting members and extending radially therefrom, each support arm having a candle support portion at its outer end and a vertically extending connecting portion at its inner end, said connecting portion having a first section and a second section extending inwardly therefrom, said second section being greater in width than said first section, said first section being snugly received in said aligned slots of said upper and lower connecting members, and said second section being received in said aligned cavities of said connecting members; a base having at its upper end a threaded portion threadedly engaged with said threaded portion of said lower connecting member to detachably connect them together; and a central decorative member having at its lower end a threaded portion threadedly engaged with said threaded portion of said upper connecting member.

Many other advantages, features and additional objects of the present invention will become manifest to those versed in the art upon making reference to the detailed description and the accompanying sheets of drawings in which preferred structural embodiments incorporating the principles of the present invention are shown by way of illustrative examples.

DESCRIPTION OF THE PREFERRED EMBODIMENTS

Figure 1:
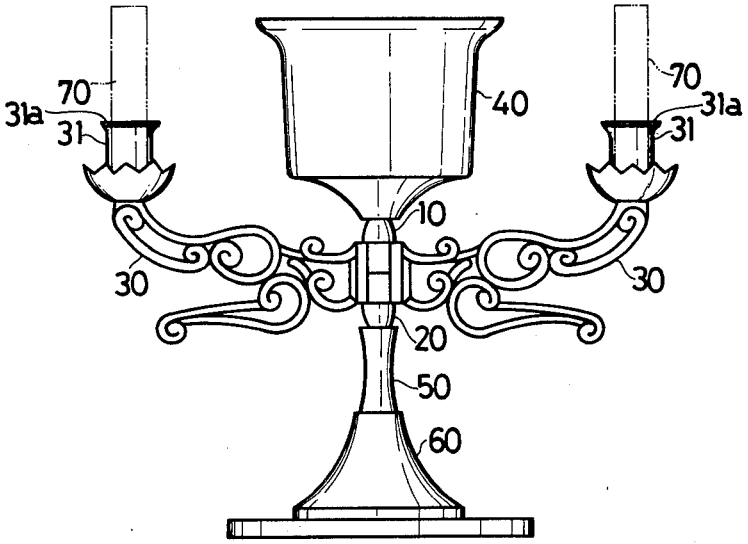
FIG. 1 is a front elevational view of a flambeau provided in accordance with the present invention.

A flambeau shown in FIG. 1 comprises a base 60, a pair of upper and lower connecting members 10, 20 connected in end to end relation, an interconnecting member 50 interconnecting the lower connecting member 20 and the base 60, three radially extending support arms 30 of identical configuration connected at their inner ends to the upper and lower connecting members 10, 20, and a central decorative member 40 of a cup-shape secured at its lower end to the upper connecting member 10. These component parts are made of a plastic material, their surfaces being aluminized to have a metallic luster. The component parts may be made of metal. The assembled flambeau can be disassembled into these component parts as shown in FIG. 2.

Figure 3:
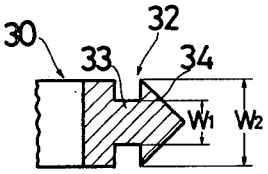
FIG. 3 is a cross-sectional view of a connecting portion of a support arm taken along the line III—III of FIG. 2.

Three support arms 30 extend radially outwardly from the upper and lower connecting members 10, 20. Each of the support arms 30 has a candle support portion 31 of a tubular shape extending upwardly from its outer end, the axis of the candle support portion 31 being disposed vertically. A tubular receptive member 31*a* with a closed bottom is fitted in each of the candle support portion 31, the receptive member being made of metal. As shown in phantom in FIG. 1, a candle 70 is adapted to be received at its lower end into each receptive member 31*a*. The support arm 30 has at its inner end a vertically extending connecting portion 32 through which it is connected to the upper and lower connecting members 10, 20, as described later. As best shown in FIG. 3, the connecting portion 32 has a first section 33 of a reduced width and a second section 34 extending inwardly from the first section 33. The second section 34 is of a triangular cross-section so that the connecting portion 32 has an arrow head-like cross-section. Importantly, the width $W_2$ of the second section 34 is greater than the width $W_1$ of the first section 33. The second section 34 may have a cross-section of any other shape such as a circular or square shape. Each support arm 30 has a major portion composed of a plurality of loop-like sections to provide a decorative pattern.

Figure 4:
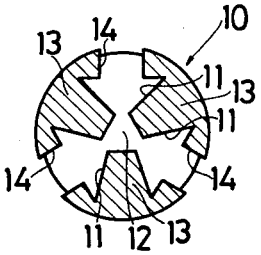
FIG. 4 is a cross-sectional view of an upper connecting member taken along the line IV—IV of FIG. 2.
Figure 2:
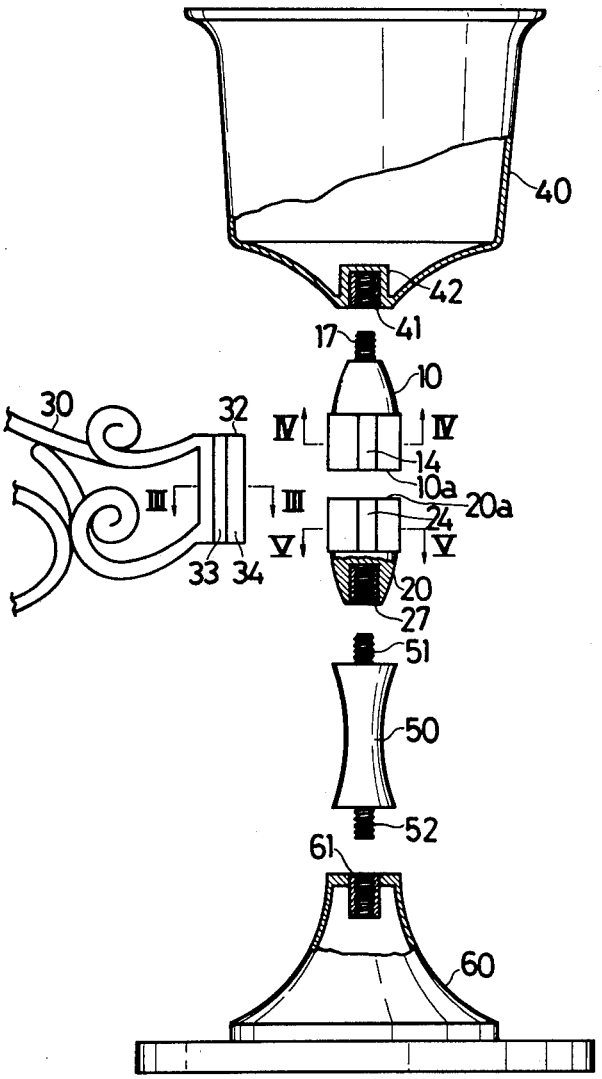
FIG. 2 is an elevational view of the flambeau as shown disassembled.

As best shown in FIGS. 2 and 4, the elongated upper connecting member 10 is of a circular cross-section and has a tapered upper portion. The lower half of the connecting member 10 has a uniform circular cross-section and has a cavity extending axially through the entire length thereof, the cavity opening to the lower surface 10*a* of the upper connecting member 10. The cavity is defined by three sections 11 equally radially spaced and a central section 12 into which the three sections 11 open. Three slots 14 are formed in the lower half of the upper connecting member 10 and extending outwardly from the three cavity sections 11, respectively, and open to the circumferential surface of the upper connecting member 10, the slots 14 being axially coextensive with the three cavity sections 11.

Each cavity section 11 has a triangular cross-section and is complementary to the second section 34 of the connecting portion 32. Each slot 14 is complementary to the first section 33 of the connecting portion 32. With this arrangement, the lower half of the upper connecting member 10 has three solid portion 13.

Figure 5:
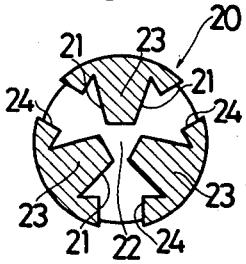
FIG. 5 is a cross-sectional view of a lower connecting member taken along the line V—V of FIG. 2.
Figure 6:
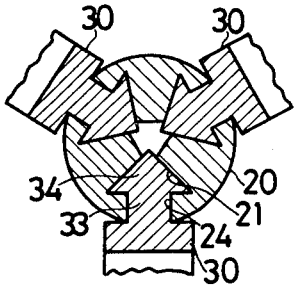
FIG. 6 is a cross-sectional view of the lower connecting member and the support arms connected together.

As shown in FIGS. 2 and 5, the elongated lower connecting member 20 is of a circular cross-section and has a tapered lower portion. The upper half of the lower connecting member 30 is substantially identical to the lower half of the upper connecting member 10. More specifically, three cavity sections 21, three slots 24, central section 22 and solid portions 23 of the lower connecting member 20 correspond to the three cavity sections 11, three slots 14, central section 12 and three solid portions 13 of the upper connecting member 10, respectively. The cavity sections 21, slots 24 and central section 22 of the lower connecting member 20 open to the upper surface 20*a* thereof. The length of the connecting portion 32 is substantially equal to the combined lengths of the lower half of the upper connecting member 10 and the upper half of the lower connecting member 20.

For connecting the three support arms 30 to the upper and lower connecting members 10, 20, the three support arms 30 are first connected to one of them. For example, the three support arms 30 are connected to the lower connecting member 20, with the lower halves of the connecting portions 32 received into the respective cavity sections 21 and slots 24. Then, the upper connecting member 10 is moved toward the connecting portions 32 and is connected thereto, with the upper halves of the connecting portions 32 received in the respective cavity sections 11 and slots 14. Thus, the connection of the three support arms 30 to the upper and lower connecting members 10, 20 is completed. In other words, the two connecting members 10, 20 are connected together through the support arms 30. In this condition, the lower surface 10*a* of the upper connecting member 10 and the upper surface 20*a* of the lower connecting member 20 are mated with each other. The connecting portions 32 of the three support arms 30 are completely covered by the upper and lower connecting members 10, 20 and therefore concealed from external view. The connecting portion 32 of each support arm 30 is snugly received in the aligned cavity sections 11, 21 and the aligned slots 14, 24. In other words, the connecting portion 32 is held in frictional engagement with the aligned cavity sections 11, 21 and the aligned slots 14, 24. The opposite ends of the connecting portion 32 are held in engagement with the lower end of the tapered upper portion of the upper connecting member 10 and the upper end of the tapered lower portion of the lower connecting member 20, respectively. Thus, each support arm 30 is held against movement, and therefore there is provided a firm connection between the three support arms 30 and the mated upper and lower connecting members 10, 20.

The upper connecting member 10 has an externally threaded portion 17 of metal secured to the upper end thereof. The central decorative cup member 40 has an internally threaded portion 41 formed centrally at its lower end, this threaded portion 41 comprising an internally threaded pipe of metal received in and secured to a socket portion 42 formed in the lower end of the cup member 40. The cup member 40 is attached to the upper connecting member 10 by threading the externally threaded portion 17 into the internally threaded portion 41. The central cup member 40 serves as a decorative member for holding, for example, flower, dried flower or artificial flower. The cup member 40 may hold candles or merely serve decorative purposes.

The lower connecting member 20 is connected to the base 60 through the elongated interconnecting member 50. More specifically, the lower connecting member 20 has an internally threaded portion 27 formed at the lower end thereof, this thread portion 27 comprising an internally threaded pipe of metal embedded in the lower end of the lower connecting member 20. The interconnecting member 50 has a pair of externally threaded portions 51, 52 of metal secured to the opposite ends thereof. The base 60 comprises a base plate and a body of a frustoconical shape secured to the base plate. The base 60 has an internally threaded portion 61 at its upper end, this threaded portion comprising an internally threaded pipe of metal embedded in the upper end of the base 60. The lower connecting member 20 is connected to the base 60 through the interconnecting member 50 by threading the externally threaded portions 51, 52 of the interconnecting member 50 into the internally threaded portion 27 of the lower connecting member 20 and the internally threaded portion 61 of the base 60, respectively. The above-mentioned threaded portions of the central member 40, the upper and lower connecting members 10, 20, the interconnecting member 50 and the base 60 may be either externally or internally threaded. However, it will be appreciated that one of each pair of coacting threaded portions is externally threaded while the other is internally threaded. Further, the interconnecting member 50 may be omitted, and the lower connecting member 20 may be threaded directly to the base 60 by modifying one of the coacting threaded portions of the two members. Further, the central cup member 40 may be connected to the upper connecting member 10 through an intermediate member.

Figure 7:
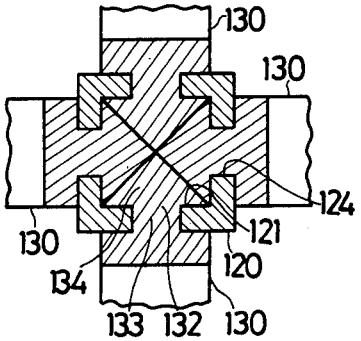
FIG. 7 is a view similar to FIG. 6 but showing a modified lower connecting member.

According to a modified form of the invention shown in FIG. 7, a lower connecting member 120 has an upper half of a square cross-section, the upper half having a cavity 121 of a square cross-section. The upper half of the lower connecting member 120 has four slots 124 formed through the four sides thereof and extending along the axis of the connecting member 120, each slot 124 being disposed centrally of the side of the upper half. Each of four support arms 130 has a connecting portion 132 which is identical in shape to the connecting portion 32 of the support arm 30 in the first embodiment. The lower halves of the triangular second sections 134 of the four connecting portions 132 are received in the cavity 121 of the lower connecting member 120. The two end faces of each second section 134 are mated with the end faces of the adjacent second sections 134, as shown in FIG. 7. The first sections 132 of the four connecting portions 132 are received in the four slots 124, respectively. Although not shown in the drawings, the lower half of a coacting upper connecting member is substantially identical in construction to the upper half of the lower connecting member 120.

Since the flambeau according to the invention, can be disassembled into the upper and lower connecting members, the support arms, the cup member, the interconnecting member and the base, the flambeau can be packaged in a compact manner. Further, the flambeau has a highly decorative design and is aesthetically appealing.

Although the flambeau according to the invention has been specifically described herein, it is not to be restricted to the exact showing of the drawings or the description thereof. For example, two or more than four support arms may be provided.

What is claimed is:

1. A flambeau comprising:

(a) a pair of upper and lower elongated connecting members having a pair of axial cavities formed in their respective portions disposed adjacent to each other, said cavities opening to the one ends of said connecting members, respectively, and being disposed in alignment with each other, each of said connecting members having a plurality of axial slots formed in said adjacent portion thereof and extending radially outwardly from said cavity and opening to the side thereof, said plurality of slots in said upper connecting member being disposed in alignment with said plurality of slots in said lower connecting member, said upper connecting member haivng a threaded portion at the other end thereof, and said lower connecting member having a threaded portion at the other end thereof;

(b) a plurality of support arms detachably connected at their inner ends to said upper and lower connecting members and extending radially therefrom, each support arm having a candle support portion at its outer end and a vertically extending connecting portion at its inner end, said connecting portion having a first section and a second section extending inwardly therefrom, said second section being greater in width than said first section, said first section being snugly received in said aligned slots of said upper and lower connecting members, said second section being snugly received in said aligned cavities of said connecting members, and said upper and lower connecting members being mated together at said one ends so that said connecting portions are completely covered by said connecting members;

(c) a base having at its upper end a threaded portion threadedly engaged with said threaded portion of said lower connecting member to detachably connect them together; and (d) a central decorative member having at its lower end a threaded portion threadedly engaged with said threaded portion of said upper connecting member.

2. A flambeau according to claim 1, in which said second section of said connecting portion has a triangular cross-section so that said connecting portion of said support arm has an arrow head-like configuration.

3. A flambeau according to claim 2, in which said adjacent portions of said upper and lower connecting members have a circular cross-section, said cavity having a plurality of cavity sections each complementary in shape to said second section of said connecting portion, each of said slots extending radially outwardly from a respective one of said cavity sections.

4. A flambeau according to claim 2, in which said adjacent portions of said upper and lower connecting members has a square cross-section, said cavity having a square cross-section, and the two end faces of said second section of each connecting portion being mated with the end faces of the adjacent second sections, respectively.

5. A flambeau according to claim 1, further including an interconnecting member through which said lower connecting member is connected to said base.

6. A flambeau according to claim 1, in which said decorative member is a cup-shaped.

* * * * *